United States Patent [19]

Morris

[11] Patent Number: 4,974,868

[45] Date of Patent: Dec. 4, 1990

[54] MODIFIED SNOWBOARD

[76] Inventor: James K. Morris, 312 No. Stadium Way, Apt. 402, Tacoma, Wash. 98403

[21] Appl. No.: 430,017

[22] Filed: Nov. 1, 1989

[51] Int. Cl.[5] ..... A63C 5/03

[52] U.S. Cl. ..... 280/609; 280/14.2; 280/28; 441/74

[58] Field of Search ..... 280/609, 607, 600, 604, 280/28, 18, 14.2, 14.3, 609, 608; 441/74, 78, 76

[56] References Cited

U.S. PATENT DOCUMENTS

| | | | |
|---|---|---|---|
| 2,914,335 | 11/1959 | Rivard | 441/68 |
| 3,007,617 | 2/1963 | Steffel | 9/310 |
| 3,295,859 | 1/1967 | Perry | 280/11.13 |
| 3,782,744 | 1/1974 | Milovich et al. | 280/18 |
| 3,814,417 | 6/1974 | Catlin | 272/56.5 |
| 4,083,577 | 4/1978 | Ford | 280/609 |

FOREIGN PATENT DOCUMENTS

| | | | |
|---|---|---|---|
| 2711930 | 9/1978 | Denmark | 280/14.2 |

*Primary Examiner*—David M. Mitchell

*Attorney, Agent, or Firm*—Cassidy, Vance & Tarleton

[57] ABSTRACT

A modified snowboard (10) having transverse channels (28) formed in a convex bottom (14) to facilitate movement through the snow. The sides (46) and (48) project beyond the bottom (38) of a snowboard (36) to form longitudinal grooves (54) with downwardly extending edges (56) to increase maneuverability and stability of the snowboard both at slow and high speeds. Upwardly projecting flanges (74) extend the length of the sides (64) and (66) of a snowboard (62) to prevent snow from moving over the top (72).

6 Claims, 2 Drawing Sheets

MODIFIED SNOWBOARD

TECHNICAL FIELD

The present invention pertains to boards for carrying one or more riders on snow, and, more particularly to a snowboard having a modified bottom to increase rider control and stability.

BACKGROUND OF THE INVENTION

The modern sport of snowboarding has evolved from barely-controllable foot sleds to precision-designed snowboards having controllability similar to much-narrower snow skis. With both feet in an angled tandem stance in the bindings, a rider uses a combination of weight-shifting and rotational turning to maneuver the snowboard down a snow-covered slope.

One difficulty in using snowboards is preventing or controlling movement when the snowboard is stopped or slowly moving. Because the bottom of the snowboard is relatively flat and smooth, and because snowboard riders do not use ski poles, the snowboard easily slides in any direction when it is stopped or slowly moving. This can be dangerous for the inexperienced rider who could unintentionally collide with an object or another rider.

A further disadvantage in using these wide snowboards is the difficulty in rapidly changing edges while moving down the slope in order to quickly change direction. One proposal for enhancing edge changes is to narrow the width of the snowboard. However, this has the limitation of allowing the rider's heels and toes to drag in the snow.

Finally, many of the physically-impaired, the elderly, and the out-of-shape are unable to participate in snowboarding because of the physical strength, agility, and stamina required to control the snowboard. Hence, there is a need for a modified snowboard that can accommodate these riders while achieving greater control and stability.

SUMMARY OF THE INVENTION

The present invention is directed to a snowboard for supporting the full weight of one or more riders on snow. The snowboard comprises an elongate base having a top, a bottom, a pair of mutually opposed sides, a tail, and a nose. The bottom has a convex cross-sectional shape from side to side. The base has a length measured from the tail to the nose. At least one channel is formed transversely through the bottom from side to side, with the channel having a width in the preferred range of 4 percent to 8 percent of the length of the base.

In accordance with another aspect of the present invention, each of the transverse channels has smoothly curving sidewalls. Ideally, the sidewalls converge towards each other and meet at a center of each of the channels.

In accordance with yet another aspect of the present invention, each of the sides projects beyond the bottom of the snowboard a distance that is less than the maximum thickness of the convex-shaped bottom to form a longitudinal groove that is adjacent and substantially parallel to each side from the tail to adjacent the nose.

In accordance with a further aspect of the present invention, the longitudinal grooves have outwardly diverging side surfaces. Preferably, each of the sides do not project beyond the bottom and no longitudinal groove is formed at each location where each of the channels are formed in the bottom.

In accordance with still yet another aspect of the present invention, each of the sides projects above the top of the base to form a pair of upwardly projecting flanges.

As will be readily appreciated from the foregoing description, the present invention provides a snowboard that increases maneuverability and stability. In particular, the downwardly extending sides facilitate better edge carving of the snow during turns. In addition, the lateral grooves allow snow to escape from under the snowboard, especially while in turns, to increase cornering speed. Furthermore, the convex bottom facilitates rapid changing between edges. Finally, the extended edge width increases edge contact with the snow to compensate for loss of edge length at the groove locations to maintain controllability and enhance dynamic stability.

BRIEF DESCRIPTION OF THE DRAWINGS

The foregoing and other features and advantages of the present invention will be more readily appreciated as the same becomes better understood from the detailed description when taken in conjunction with the following drawings, wherein.

DETAILED DESCRIPTION OF THE PREFERRED EMBODIMENT

Figure 1:
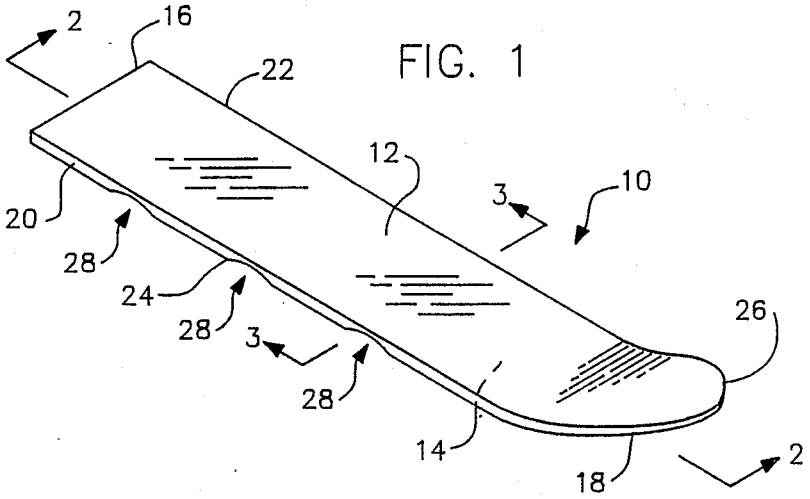
FIG. 1 is an isometric view of a snowboard formed in accordance with the present invention.

Referring initially to FIG. 1, a modified snowboard 10 is shown having a top 12, a bottom 14, a tail 16 at the rear end, a nose 18 at the front end, and a first side 20 and a second side 22 that are substantially orthogonal to the top 12 and bottom 14. The first side 20 and the second side 22 have lower edges 24 that run from the tail 16 to the nose 18. The nose 18 is upwardly curved with the first and second sides 20 and 22 meeting together at a tip 26.

Figure 2:
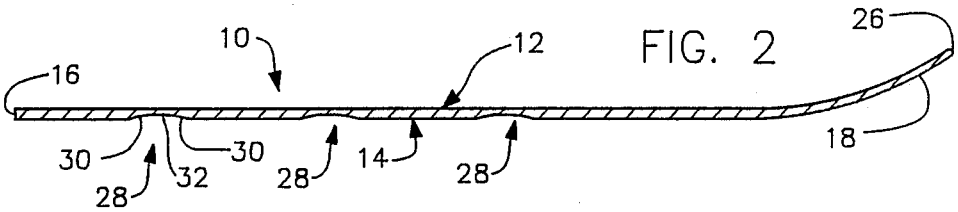
FIG. 2 is a cross-sectional side view of the snowboard of FIG. 1.

Referring next to FIG. 2, the cross-sectional view shows three transverse channels 28 formed in the bottom 14 of the snowboard 10. Each channel 28 extends the entire width of the snowboard 10, which is defined as the distance between the first side 20 and the second side 22. Each channel 28 has smoothly curving side surfaces 30 that meet together at a center 32. The width of each groove 28, which is defined as the maximum distance between the side surfaces 30, is preferably in the range of 4 percent to 8 percent of the total length of the snowboard 10, which is defined as the distance between the tail 16 and the tip 26. In addition, the depth of each groove 28, which is defined as the distance between the bottom 14 of the snowboard and the center 32 of the channel 28, is in the preferred range of 50 percent to 75 percent of the thickness of the snowboard 10, which is defined as the distance between the top 12 and the bottom 14 at its maximum thickness.

Each channel 28 runs from the first side 20 to the second side 22, thus dividing the bottom 14 into four planar sections 34. Ideally, the channels 28 are evenly spaced from one another, with the first channel adjacent the tail 16 being spaced from the tail 16 a distance that is approximately one-twelfth the length of the snowboard 10. For instance, if the snowboard 10 had a measured length of 48 inches as measured in a straight line from the tail 16 to the tip 26 in the plane of the bottom 14, then preferably the first channel would begin approximately 16 inches from the tail 16 and have a maximum width of approximately 3 inches. If the total thickness of the snowboard 10 were one-half inch, then each channel 28 would have a maximum depth of three-eighth inches.

Figure 3:
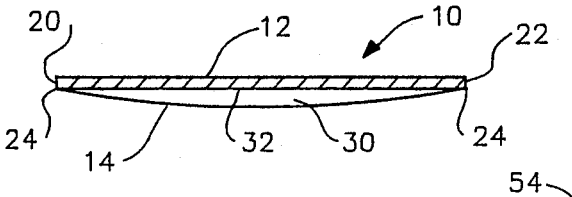
FIG. 3 is a cross-sectional end view of the snowboard of FIG. 1.

FIG. 3 is a cross section taken through the center 32 of a channel 28. This view shows the convex shape of the bottom 14. This convex shape facilitates rapid changing between the lower edges 24 on the first side 20 and the second side 22 by a rocking action. Rocking over onto the lower edges 24 makes it easier for a rider to dig the lower edges 24 into the snow to carve out a turn. In addition, there is less surface contact between the bottom 14 and the snow because of the convex shape of the bottom 14 when the snowboard 10 is rocked over onto one of the lower edges 24. Finally, the transverse channels 28 prevent the accumulation of snow beneath the snowboard 10 by allowing the snow to escape out of either side 20 and 22.

It is to be understood that the snowboard 10 may be formed from a single substance, such as wood, or, as is the current practice in the industry, the snowboard 10 may be formed from a plurality of fiberglass laminates built around a core of polyurethane or wood.

Figure 4:
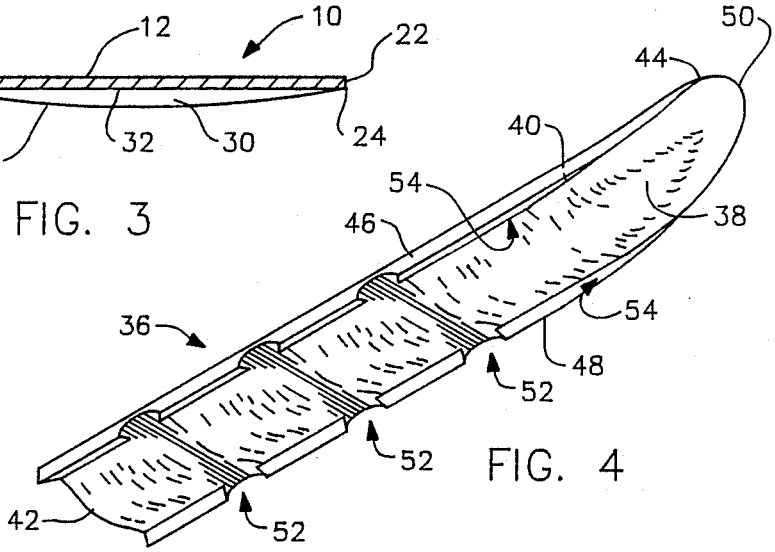
FIG. 4 is a bottom isometric view of an alternative embodiment of a snowboard formed in accordance with the present invention.

FIG. 4 illustrates an alternative embodiment of the present invention wherein a modified snowboard 36 is illustrated to have a convex bottom 38, a top 40, a tail 42, a nose 44, and a pair of mutually-opposed sides 46 and 48. The nose 44 is curved upward with the sides 46 and 48 meeting at a tip 50 at the top of the nose 44. Three transverse channels 52 are formed in the bottom 38 of the snowboard 36 having the same size and shape configuration as described above with respect to the snowboard 10 of FIGS. 1–3. Each side 46 and 48 does not project below the bottom 38 and no longitudinal groove 54 is formed at each location where the channels 52 intersect with the sides 46 and 48.

Figure 5:
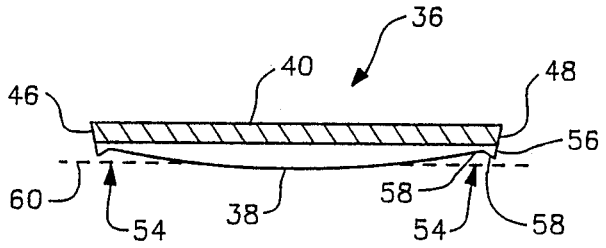
FIG. 5 is a cross-sectional end view of the snowboard of FIG. 4.

In the alternative embodiment depicted in FIG. 4, the snowboard 36 has the two sides 46 and 48 extending below the bottom 38 to form a longitudinal groove 54 adjacent each side 46 and 48. This is shown more clearly in FIG. 5, wherein each side 46 and 48 projects below the bottom 38 to form a downwardly projecting edge 56. Each groove 54 has outwardly diverging side surfaces 58. In order to prevent unintentional grabbing of the edges 56 in the snow, it is important that each edge project below the bottom 38 a distance that is less than the maximum thickness of the snowboard 36, as indicated by the dotted line 60.

Figure 6:
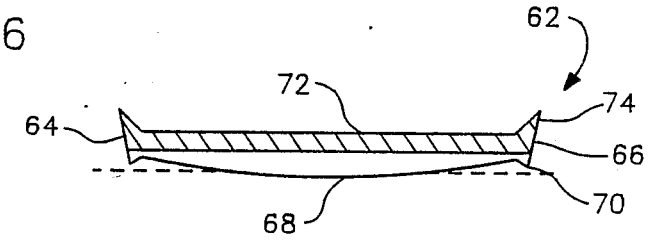
FIG. 6 is a cross-sectional end view of an alternative embodiment of a snowboard formed in accordance with the present invention.

FIG. 6 illustrates still yet another alternative embodiment wherein a modified snowboard 62 has modified sides 64 and 66 that project not only below the bottom 68 to form edges 70, but also project above the top 72 to form flanges 74 that run from the tail to adjacent the nose. These upwardly projecting flanges 74 increase the width of the sides 64 and 66 to provide more contact with the snow and the flanges 74 prevent snow from being forced over onto the top 72 of the snowboard 62.

While a preferred embodiment of the invention has been illustrated and described, it is to be understood that various changes may be made therein without departing from the spirit and scope of the invention. Consequently, the invention is to be limited only by the scope of the claims that follow.

The embodiments of the invention in which an exclusive property or privilege is claimed are defined as follows:

1. A snowboard for supporting the full weight of one or more riders on snow, comprising:

an elongate base having a top, a bottom, a pair of mutually opposed sides, a tail, and a nose, said bottom having a convex cross-sectional shape, said base having a length measured from the tail to the nose, and at least one channel formed transversely through said bottom, said channel having a width in the preferred range of 4 percent to 8 percent of the length of said base.

2. The snowboard of claim 1, wherein each of said one or more transverse channels has smoothly curving sidewalls that converge towards each other and meet at a center of each of said one or more channels.

3. The snowboard of claim 2, wherein each of said sides projects beyond said bottom a distance that is less than the maximum thickness of said convex-shaped bottom to form a longitudinal groove adjacent and substantially parallel to each side from the tail to adjacent the nose.

4. The snowboard of claim 3, wherein each of said longitudinal grooves has outwardly diverging side surfaces.

5. The snowboard of claim 4, wherein each of said sides do not project beyond said bottom and no longitudinal groove is formed at each location where each of said one or more channels are formed in said bottom.

6. The snowboard of claim 2, wherein each of said sides projects above the top of said base to form a pair of upwardly projecting flanges.

* * * * *